US006510629B1

(12) United States Patent
Smidt et al.

(10) Patent No.: US 6,510,629 B1
(45) Date of Patent: Jan. 28, 2003

(54) BADGE AND METHOD OF MAKING IT

(75) Inventors: Jacobus Fick Smidt, Bellville (ZA); Margaret Patricia McMurray, Somerset West (ZA); Ulrich Vogeli, Tableview (ZA); Paul Pothmann, Durbanville (ZA)

(73) Assignee: The Badge Company (Proprietary) Limited, Bellville (ZA)

( * ) Notice: Subject to any disclaimer, the term of this patent is extended or adjusted under 35 U.S.C. 154(b) by 0 days.

(21) Appl. No.: 09/689,112

(22) Filed: Oct. 12, 2000

Related U.S. Application Data

(63) Continuation of application No. 08/928,536, filed on Sep. 12, 1997, now abandoned.

(51) Int. Cl.[7] ..... A44C 3/00

(52) U.S. Cl. ..... 40/1.5; 40/586; 24/3.12

(58) Field of Search ..... 40/1.5, 662, 663, 40/586; 63/20; 411/504; 24/3.12, 3.5, 703.2

(56) References Cited

U.S. PATENT DOCUMENTS

| | | | | | |
|---|---|---|---|---|---|
| 982,298 | A | * | 1/1911 | Pollock | 24/707.7 |
| 1,200,287 | A | * | 10/1916 | Wilson | 24/3.12 |
| 2,377,688 | A | * | 6/1945 | Hubbell | 63/20 |
| 2,451,913 | A | * | 10/1948 | Brice | 428/67 |
| 2,863,235 | A | * | 12/1958 | Krause | 40/1.5 |
| 3,142,088 | A | * | 7/1964 | Cravath | 16/441 |
| 3,184,759 | A | * | 5/1965 | Masters | 2/279 |
| 3,439,439 | A | * | 4/1969 | Stimson | 40/1.5 |
| 3,466,779 | A | * | 9/1969 | Zucker et al. | 40/586 |
| 3,931,688 | A | | 1/1976 | Owens | |
| 4,338,737 | A | * | 7/1982 | Lehmann | 40/1.5 |
| 4,344,240 | A | * | 8/1982 | Schiller | 40/662 |
| 4,597,146 | A | | 7/1986 | Larin | |
| 4,597,206 | A | | 7/1986 | Benson | |
| 4,691,457 | A | * | 9/1987 | Peroni | 40/768 |
| 4,777,704 | A | * | 10/1988 | Acker | 24/106 |
| 4,858,358 | A | | 8/1989 | Gagnon | |
| 4,901,422 | A | | 2/1990 | Woods | |
| 5,010,665 | A | | 4/1991 | Clinkscales | |
| 5,050,323 | A | | 9/1991 | Gagnon | |
| 5,067,265 | A | | 11/1991 | Harms | |
| 5,191,682 | A | | 3/1993 | Davis-Reardon | |
| 5,472,547 | A | | 12/1995 | McKye et al. | |
| 5,504,976 | A | * | 4/1996 | Reeves | 24/3.1 |
| 5,715,215 | A | | 2/1998 | Haas et al. | |

FOREIGN PATENT DOCUMENTS

| | | |
|---|---|---|
| DE | 3826293 | 3/1989 |
| FR | 2665341 | 2/1992 |
| FR | 2682014 | 4/1993 |
| NZ | 102618 | 7/1953 |
| NZ | 129364 | 2/1964 |
| WO | 9408483 | 4/1994 |

* cited by examiner

*Primary Examiner*—William L. Miller

(57) ABSTRACT

A badge comprises a backing element (12) of flexible sheet material and an insignia device (18, 20) on the front face of the backing element, the insignia device having rearwardly extending studs (22) of thermoplastic material, and the studs penetrating the backing element and having their rear ends melted back to form thickened portions (24, 24.1) which secure the studs against withdrawal. In one form thereof the badge is provided with a clip arm (46) which has a button formation (86) thereon, the button formation being able to engage with a button-hole in the garment with which the badge is used.

5 Claims, 4 Drawing Sheets

FIG. 7
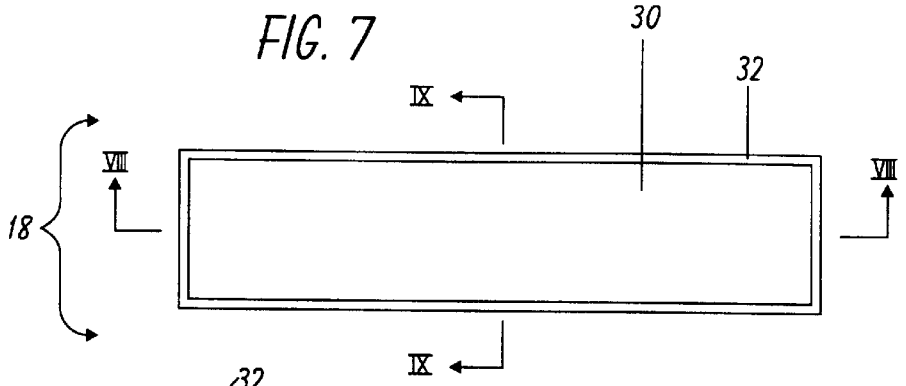
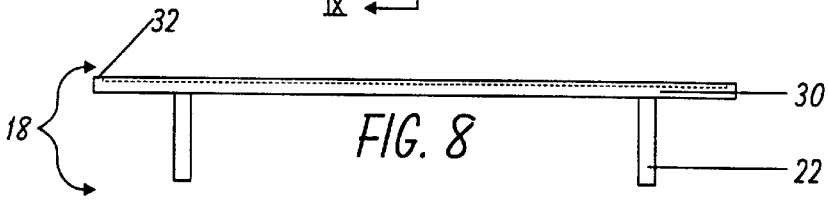
FIG. 8
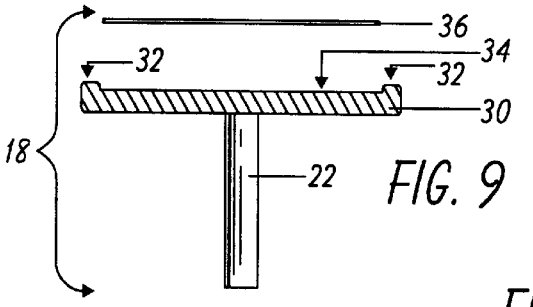
FIG. 9
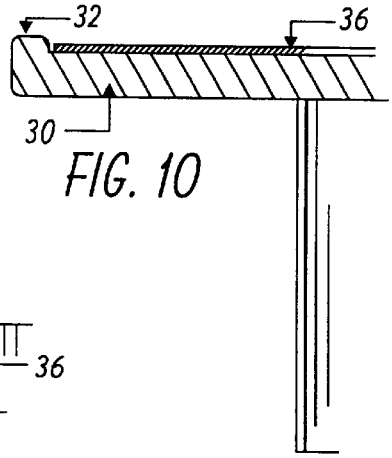
FIG. 10
FIG. 11
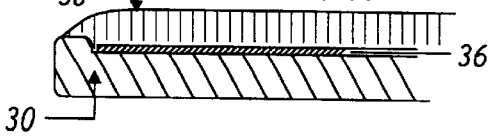
FIG. 12
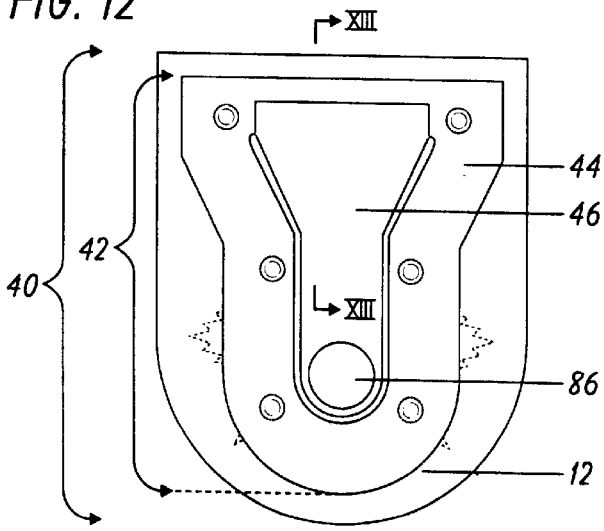

FIG. 16
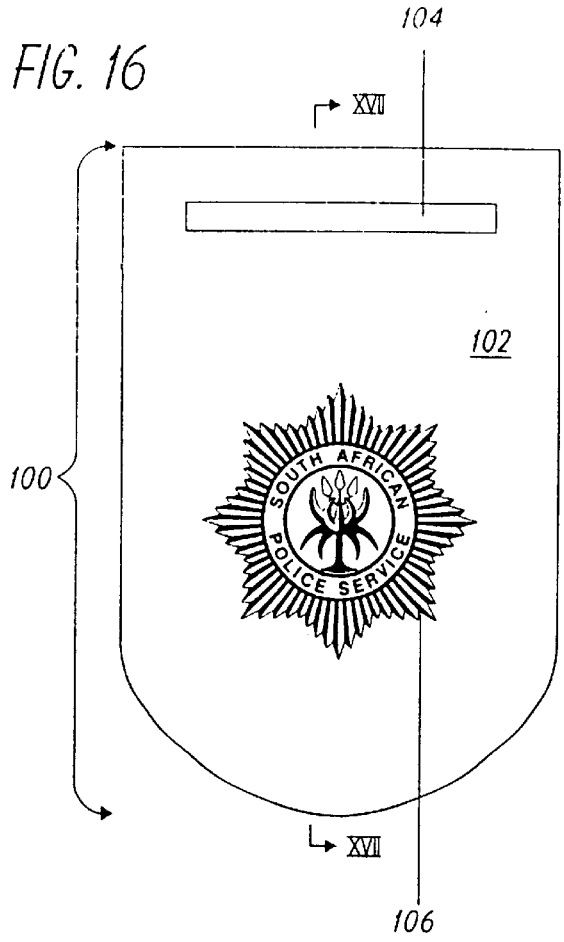
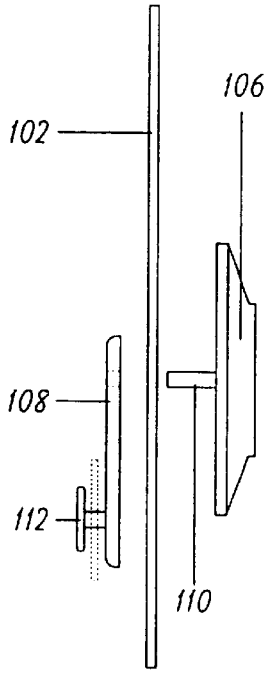
FIG. 17
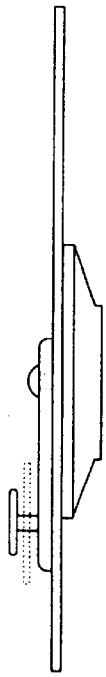
FIG. 18

BADGE AND METHOD OF MAKING IT

This patent application is a continuation of U.S. patent application Ser. No. 08/928,536, filed on Sep. 12, 1997, now abandoned.

BACKGROUND TO THE INVENTION

THIS INVENTION relates to a badge and more particularly a badge of the type used by military, para-military, police, or other law enforcement services to indicate the name, rank, and/or affiliation of a person. It also relates to a method of making such a badge.

SUMMARY OF THE INVENTION

According to the invention there is provided a badge which comprises a backing element of flexible sheet material having a front face and a rear face and is cut to define the outline of the badge, and an insignia device of moulded plastics material on said front face and affixed to the sheet material.

The insignia device may have a rearwardly extending stud of thermoplastic material, the stud penetrating the backing element and having had its rear end melted back to form a thickened portion which secures the stud against withdrawal from the backing element.

The insignia device including the stud may be an injection moulded component of thermoplastic material.

Further according to the invention there is provided a method of making a badge of the type comprising a backing element of flexible sheet material having a front face and a rear face, and an insignia device on said front face, wherein the insignia device is provided as an element with a rearwardly extending stud of thermoplastic material, wherein the stud is caused to penetrate the backing element, and wherein the rear end of the stud is then melted back so as to form the stud with a thickened portion which secures the stud against withdrawal from the backing element.

Where the badge is provided with a fixing element on the rear face of the backing element, the stud may be caused to pass also through a close-fitting opening in the fixing element before being melted back, the thickened portion in this event securing the stud against withdrawal from the opening in the fixing element.

Further according to the invention there is provided a badge which comprises a backing element of flexible sheet material having a front face and a rear face, and an insignia device on said front face, the insignia device being in the form of an element with a rearwardly extending stud of thermoplastic material, and the stud penetrating the backing element and having had its rear end melted back to form a thickened portion which secures the stud against withdrawal from the backing element.

The badge may further comprise a fixing element on the rear face of the backing element, the stud also passing through a close-fitting opening in the fixing element, whereby the thickened portion secures the stud against withdrawal from the opening in the fixing element.

The badge may comprise two or more of said insignia devices, each insignia device being in the form of an element with a rearwardly extending stud of thermoplastic material, and the stud of each insignia device passing through a corresponding close-fitting opening in the fixing element.

The fixing element may be an injection moulded component.

The fixing element may comprise a base plate lying face-to-face on the backing element, and a clip arm for clipping the badge to a belt or garment pocket, the clip arm being formed integrally with the base plate.

The clip arm may be provided with rearwardly protruding means for positively affixing the badge to a garment. Said means may be in the form of a button formation.

The button formation may be provided at or near the free end of the clip arm.

In one form of the invention the insignia device may in the form of a name plate, the name plate comprising a backing plate, an insignia strip applied to a front face of the backing plate, the edges of the insignia strip being set back from the edges of the backing plate, and a covering of hardened epoxy resin covering the insignia strip and edge portions of the backing plate peripherally of the insignia strip.

The resin may form a convex meniscus.

The backing plate may have a peripherally extending rim, the insignia strip being a close fit within the confines of the rim.

Further according to the invention there is provided a badge which comprises a clip arm for clipping the badge to a garment pocket, and a securing element attached or attachable to the clip arm, the securing element being adapted to pass through an opening in the material defining said pocket, thereby to secure the badge against dislodgement from the garment.

The securing element may be in the form of a rearwardly protruding button formation.

In one form of the invention the button formation may be irremovably connected to the clip arm.

The clip arm may have a screw-threaded hole therein, the button formation comprising a screw-threaded button stem whereby the button formation can be screwed into the screw-threaded hole.

Further according to the invention there is provided a badge and garment combination, wherein the badge has a rearwardly protruding button formation and wherein there is a button-hole in the garment or in a piece of fabric affixed to the garment, the button formation cooperating with the button hole to hold the badge in place on the garment.

Further according to the invention there is provided a badge which has a rearwardly protruding button formation adapted to pass through a button hole in a garment or in a piece of fabric affixed to the garment.

In one form of the invention the badge may be in the form of a shoulder flash having a slot therein at an upper end thereof, through which an epaulette flap of the garment can pass, the button formation being at or near the lower end of the badge.

In another form of the invention the badge may comprise a backing element of flexible sheet material having a front face and a rear face, an insignia device on said front face, and a fixing element on said rear face, the button formation being on the fixing element, and the insignia device being fastened to the fixing element via one or more studs passing through the backing element.

Further according to the invention there is provided, in combination, a badge which has a rearwardly protruding button formation, and a piece of fabric having a button-hole therein through which the button formation can pass, the piece of fabric being affixable to a garment with which the badge is to be used.

The piece of fabric may be in the form of a pocket having front and rear panels, the button-hole being in the rear panel of the pocket.

The invention will now be described in more detail, by way of example, with reference to the accompanying drawings.

BRIEF DESCRIPTION OF THE DRAWINGS

In the drawings:

FIG. 7 is a front view of a base plate for use in making a name plate forming part of the badge;

FIG. 8 is a side elevation of the base plate, in the direction of arrows VIII—VIII in FIG. 7;

FIG. 9 is a section on IX—IX in FIG. 7, showing the name plate during a first stage of its manufacture;

FIG. 10 is an enlargement of part of FIG. 9, showing the name plate during a second stage of its manufacture;

FIG. 11 is a view similar to FIG. 10, but showing the name plate in its completed form;

FIG. 12 is a rear view of a badge in accordance with another embodiment of the invention, the badge including a fixing element which is provided with a clip arm;

FIG. 16 is a plan view of a badge in accordance with another embodiment of the invention;

FIG. 17 is a view in the direction of arrows XVII—XVII in FIG. 16, showing the parts of the badge prior to assembly; and FIG. 18 is a view similar to FIG. 17, but showing the parts in their assembled condition.

DETAILED DESCRIPTION OF PREFERRED EMBODIMENTS

Figure 1:
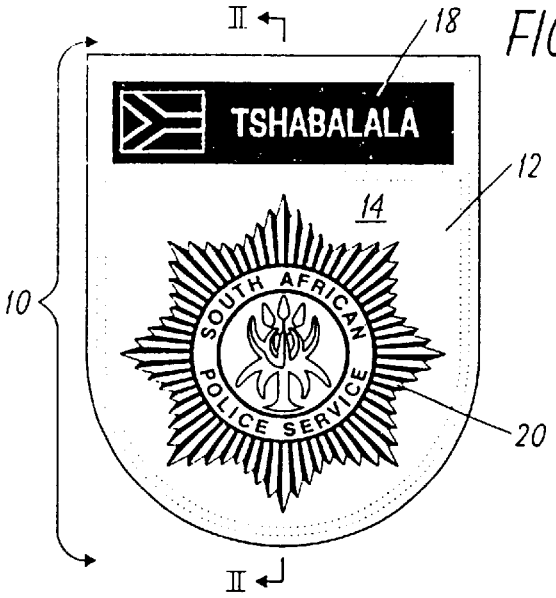
FIG. 1 is a plan view of a badge in accordance with one embodiment of the invention.

Referring first to FIGS. 1 to 5, reference numeral 10 generally indicates a badge which comprises a backing element 12 of flexible sheet material having a front face 14 and a rear face 16, a first insignia device in the form of a name plate 18 on the front face, and a second insignia device in the form of an embossment 20 also on the front face 14.

Each of the insignia devices 18 and 20 are formed as an element which has a plurality of rearwardly extending thermoplastic studs 22.

Figure 5:
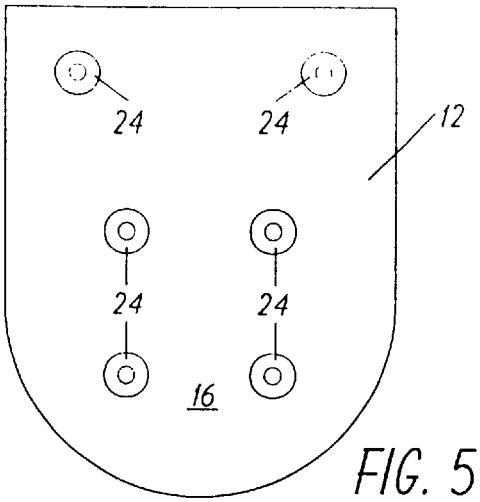
FIG. 5 is a rear view of the badge in its completed form.
Figure 2:
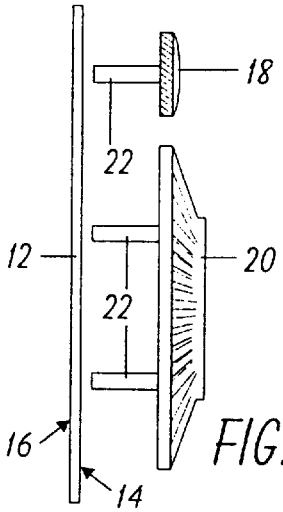
FIG. 2 is a view in the direction of II—II in FIG. 1, showing the badge during a first stage of its manufacture.
Figure 3:
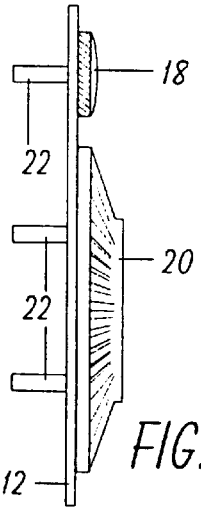
FIG. 3 is a view similar to FIG. 2, but showing the badge during a second stage of its manufacture.
Figure 4:
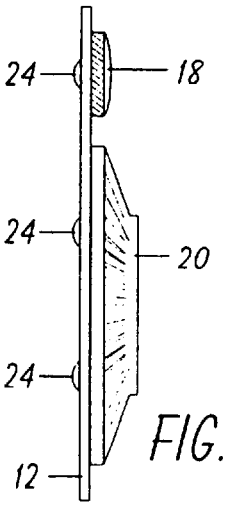
FIG. 4 is a view similar to FIGS. 2 and 3, but showing the badge in its completed form.

In manufacturing the badge 10, the insignia devices 18 and 20 are affixed to the backing element 12 by causing the studs 22 to penetrate the backing element, until they are in the position illustrated in FIG. 3. The badge is then placed in a press having hot plungers or ultrasonic welding horns which are pressed down on the protruding ends of the studs 22. This causes the studs 22 to be melted back to form them into rounded, button-like portions 24 on the rear face 16, as shown in FIGS. 4 and 5. The button-like formations 24 will prevent the studs 22 from being withdrawn from the backing element 12.

Figure 6:
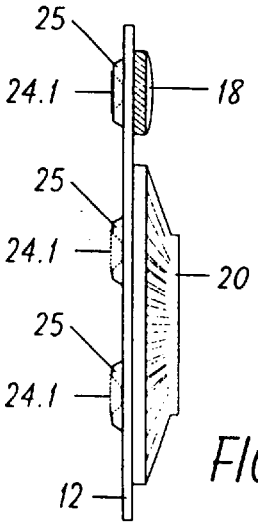
FIG. 6 is a view similar to FIG. 4, but showing an alternative construction.
Figure 13:
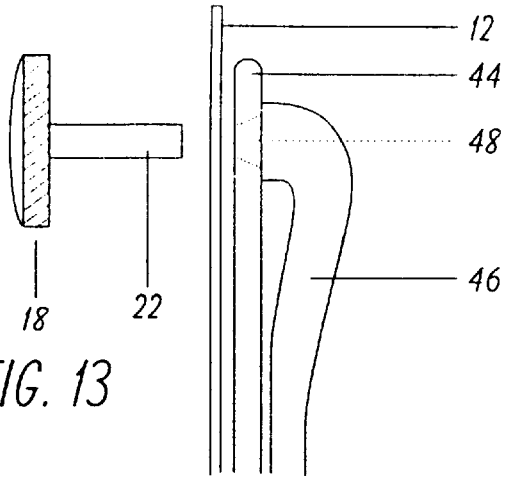
FIG. 13 is a view in the direction of arrows XIII—XIII in FIG. 12, of the upper part of the badge, drawn to a larger scale and showing the parts thereof prior to assembly.

In the construction illustrated in FIG. 6, a washer-like element 25 is slid onto each of the studs 22 before the stud is melted back. The element 25 can have a flared opening therein so that the studs 22 can be melted back until their ends are flush with the rear face of the elements 25, as indicated at 24.1.

The method by which the name plate 18 is manufactured will now be described with reference to FIGS. 7 to 11.

The name plate 18 comprises an injection moulded base plate 30 of thermoplastic material, the studs 22 extending from, and forming an integral part of, the base plate. The base plate 30 has, on the front face thereof, a peripherally extending rim 32 which forms a rectangular well 34. During manufacture of the name plate 18 an insignia strip 36 comprising a piece of printed foil or other material of rectangular outline is placed into the well 34 (FIGS. 9 and 10). A number of the insignia strips 36 will be manufactured in large sheets which have, for example, been screen-printed and die-cut, to provide a number of the insignia strips 36 as peel-off strips which have an adhesive backing. Thus, when the insignia strip 36 is pressed down into the well 34, it will adhesively attach itself to the bottom of the well. There is a little clearance between the periphery of the insignia strip 36 and the rim 32, the clearance being typically a fraction of a millimeter. This will enable the insignia strip to be placed in position relatively accurately, without skewing.

Once the insignia strip 36 has been placed in position, a clear epoxy resin which has had a hardener added thereto is poured onto the base plate 30, so as to cover the insignia strip 36. A sufficient quantity of resin is applied to the base plate to fill the well 34, overflow onto the rim 32, and form a convex meniscus as shown at 38 in FIG. 11.

The embossment 20 is an injection moulded component of thermoplastic material, the studs 22 forming an integral part of the moulding. The plastic material may be the material known as ABS, and may be metallised by, for example, having gold plating applied thereto.

The backing element 12 may be of the material that is conventionally used for this purpose in the badge making industry. This consists of a laminate of two layers of knitted fabric having, for example, a PVC layer sandwiched between them.

Referring now to FIGS. 12 to 15, there is shown a badge 40 which, in some respects is similar to the badge 10 illustrated in FIGS. 1 to 5, the same reference numerals being used to indicate the same or similar parts. The badge 40 differs from the badge 10 in that it is, in addition, provided with a fixing element 42. The fixing element 42 is an injection moulded component comprising a base plate 44 and a clip arm 46 formed integrally with the base plate.

The method of manufacturing the badge 40 is similar to that described with reference to FIGS. 2 to 5, except that the studs 22 not only penetrate the backing element 12, but also pass through close-fitting openings 48 in the base plate 44, before the rear ends thereof are melted back.

The free end of the clip arm 46 is provided with a rearwardly protruding button formation 86. The button formation 86 may be formed integrally with the clip arm 46. Alternatively, the button formation may be moulded separately, and then fixed to the clip arm by ultrasonic welding or some other method of fixing. In another alternative form the free end of the clip arm 46 may have a screw-threaded nut incorporated therein, in which event the button formation may have a screw-threaded stem whereby the button formation can be screwed into the screw-threaded nut.

A shirt, jacket, or other garment with which the badge 40 is to be used can be provided with a pocket made especially for receiving the clip arm 46.

Figure 14:
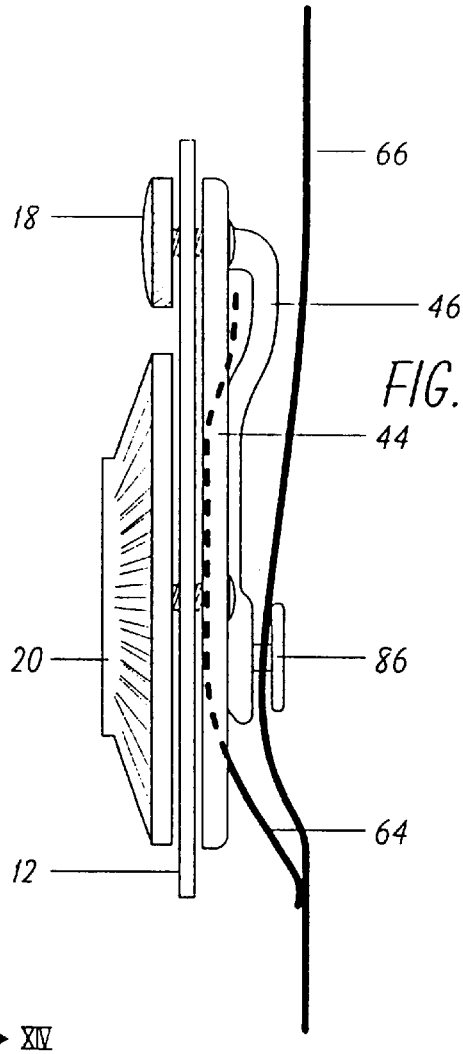
FIG. 14 is a view in the direction of XIV—XIV in FIG. 15, showing the badge of FIG. 12 in position in a pocket.

One form of such pocket is shown in FIG. 14, the pocket being formed by a piece of material 64 which is sewn along the sides and bottom to a main panel 66 of the garment. A button-hole is formed in the main panel 66, behind the piece of material 64. This enables the badge 40 to be located positively in the pocket, by engagement of the button formation 86 with the button-hole. In an alternative arrangement, where the clip arm 46 has a screw-threaded nut incorporated therein and the button formation a screw-threaded stem, the button-hole may be omitted. In this event, provided the button stem has a reasonably sharp end, the stem may simply be pressed through the main panel 66, piercing the material of the main panel, and then screwed into the screw-threaded nut. As the hole made by such piercing is behind the piece of material 64, it will not be visible from the outside of the garment and will therefore not detract from the appearance of the garment.

Figure 15:
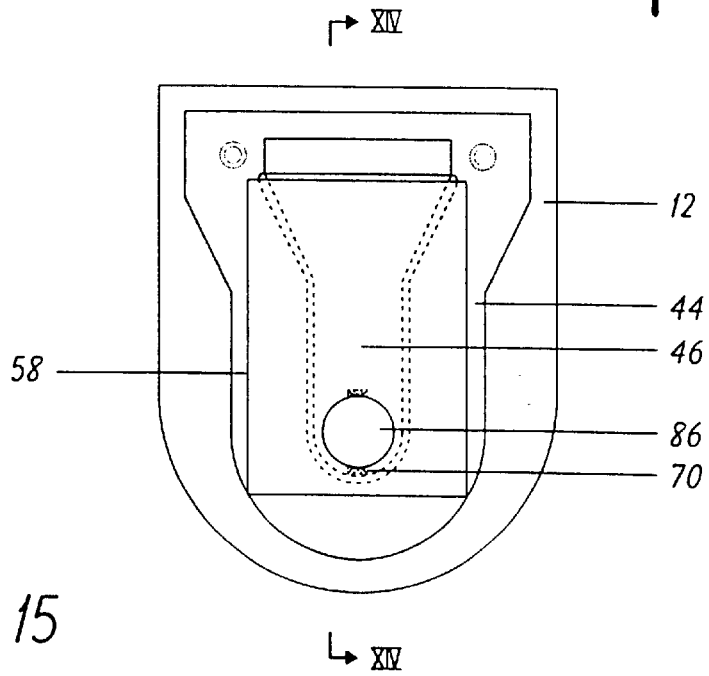
FIG. 15 is a rear view of the badge, showing it in position in a different type of pocket.

Another form of pocket is shown at 58 in FIG. 15. The pocket 58 is provided as a part separate from the garment with which it is to be used. The pocket has front and rear panels and a button-hole 70 in the rear panel. It is sewn to the inside of the garment with which it is to be used, and the garment is provided with a horizontal slit which is aligned with the top or open end of the pocket, so that the clip 46 of the badge can be inserted from the outside of the garment through the slit into the pocket, whereupon the button formation 86 can be inserted through the button-hole 70.

Referring now to FIGS. 16 to 18, reference numeral 100 indicates a badge in the form of a shoulder flash. The shoulder flash 100 comprises a backing element 102 of flexible sheet material which has a slot 104 therein through which the epaulette flap of a garment can pass, the shoulder flash extending, in use, down the arm of the person wearing it. On the backing element 102 there is fitted an embossment 106 which is similar to the embossment 20 referred to in FIGS. 1 to 6.

Behind the backing element 102 there is an injection moulded fixing element 108, the embossment 106 having studs 110 which penetrate the backing element 102 and pass through openings in the fixing element 108. The embossment 106 is affixed to the backing element 102 and the fixing element 108 by melting back the studs 110 as described with reference to FIGS. 1 to 6.

The fixing element 108 is provided with a button formation 112. The button formation 112 can be used to hold the lower end of the shoulder flash in position so that it does not flap around. This is done by providing the sleeve of the garment with which the shoulder flash is to be used with a button-hole in the appropriate position. The button formation 112 can then be inserted into the button-hole.

It is to be understood that the button formation 112 may be affixed to the backing element 102 by other means, without departing from the scope of the invention.

The button-hole with which the button formation 112 engages may either be provided in the material of the garment itself or it may be provided in a strip of material which can be sewn to the outside of the garment, either at the point of manufacture of the garment, or by the end user.

What is claimed is:

1. A badge which comprises a backing element of flexible sheet material having a front face and a rear face and is cut to define the outline of the badge, an insignia device on said front face and a fixing element on said rear face, the insignia device being an injection molded component of thermoplastic material having at least one integrally formed, rearwardly extending stud, the insignia device being affixed to the backing element by said at least one stud penetrating the backing element and passing through a close-fitting opening in the fixing element, and having a rear end melted back to form a thickened portion securing said at least one stud against withdrawal from said opening, said fixing element including means for affixing the badge to a belt or garment, wherein the insignia device is in the form of a name plate, the name plate comprising a backing plate, an insignia strip applied to a front face of the backing plate, each of the insignia strip and the backing plate having edges, the edges of the insignia strip being set back from the edges of the backing plate, and a covering of hardened epoxy resin covering the insignia strip and portions of the backing plate proximate the edges of the backing plate, peripherally of the insignia strip.

2. A badge according to claim 1, wherein the resin forms a convex meniscus.

3. A badge according to claim 1, wherein the backing plate has a peripherally extending rim, and wherein the insignia strip is a close fit within the confines of the rim.

4. A badge which comprises a backing element of flexible sheet material having a front face and a rear face and is cut to define the outline of the badge, an insignia device on said front face, and a fixing element on said rear face, the insignia device being an injection molded component of thermoplastic material having at least one integrally formed. rearwardly extending stud, the insignia device being affixed to the backing element by said at least one stud passing through a close-fitting opening in the fixing element, and having a rear end melted back to form a thickened portion securing said at least one stud against withdrawal from the opening, said fixing element comprising a base plate lying face-to-face on the backing element, and a clip arm for clipping the badge to a belt or garment, the clip arm being formed integrally with the base plate.

5. A badge which comprises a backing element of flexible sheet material having a front face and a rear face and is cut to define the outline of the badge, and an insignia device of molded plastic material on said front face, the insignia device including at least one integrally formed, rearwardly extending stud and being affixed to the backing element by said at least one stud penetrating the backing element and being secured against withdrawal from the backing element, the insignia device being in the form of a name plate which comprises a backing plate, an insignia strip applied to a front face of the backing plate, each of the insignia strip and the backing plate having edges, the edges of the insignia strip being set back from the edges of the backing plate, and a covering of hardened epoxy resin covering the insignia strip and portions of the backing plate proximate the edges of the backing plate, peripherally of the insignia strip.

* * * * *